US007018031B2

(12) United States Patent
Ward et al.

(10) Patent No.: US 7,018,031 B2
(45) Date of Patent: Mar. 28, 2006

(54) POROUS SUBSTRATE FOR INK DELIVERY SYSTEMS

(75) Inventors: Bennett C. Ward, Midlothian, VA (US); Michael W. Spencer, Richmond, VA (US); Jackie Payne, Chester, VA (US); David B. Harris, Chester, VA (US); Geoff Stoltz, Richmond, VA (US); Andreas Schneekloth, Hamburg (DE)

(73) Assignee: Filtrona Richmond, Inc., Colonial Heights, VA (US)

( * ) Notice: Subject to any disclaimer, the term of this patent is extended or adjusted under 35 U.S.C. 154(b) by 240 days.

(21) Appl. No.: 10/743,593

(22) Filed: Dec. 22, 2003

(65) Prior Publication Data

US 2005/0151805 A1 Jul. 14, 2005

Related U.S. Application Data

(60) Provisional application No. 60/436,085, filed on Dec. 23, 2002.

(51) Int. Cl.
*B41J 2/175* (2006.01)

(52) U.S. Cl. ..... 347/87; 347/86

(58) Field of Classification Search ..... 347/86, 347/87; 401/198, 222, 223; 428/364, 373, 428/374

See application file for complete search history.

(56) References Cited

U.S. PATENT DOCUMENTS 3,176,345 A 4/1965 Powell
3,192,562 A 7/1965 Powell
3,400,998 A 9/1968 Daugherty et al.
3,457,341 A 7/1969 Duncan et al.
3,467,564 A 9/1969 Daugherty et al.
3,825,379 A 7/1974 Lohkamp et al.
3,825,380 A 7/1974 Harding et al.
3,849,241 A 11/1974 Buntin et al.
3,917,448 A * 11/1975 Wood ..... 8/125
4,270,962 A 6/1981 Sugihara et al.
4,286,005 A 8/1981 Berger
4,354,889 A 10/1982 Berger
4,406,850 A 9/1983 Hills (Continued)

FOREIGN PATENT DOCUMENTS

GB 2036115 11/1979

(Continued)

OTHER PUBLICATIONS

"New Concepts in Melt-Blown Design Applied to", ECKHARD, Schwarz Biax-Fiberfilm Corp., Mar. 1987, pp. 206-220.

(Continued)

*Primary Examiner*—Anh T. N. Vo
(74) *Attorney, Agent, or Firm*—Hunton & Williams LLP

(57) ABSTRACT

An ink absorbing substrate suitable for use in inkjet printing systems is provided. The substrate comprises at least one continuous fiber bonded to itself at points of contact to form a substantially self-sustaining structure for retaining ink. The continuous fiber preferably is a bicomponent fiber having a core material and a sheath material at least partially surrounding the core material. The core material preferably is a crystalline thermoplastic polymer and the sheath material preferably is low density polyethylene modified with a cycloolefin copolymer.

17 Claims, 2 Drawing Sheets

U.S. PATENT DOCUMENTS

| | | | | |
|---|---|---|---|---|
| 4,729,808 | A | 3/1988 | Berger | |
| 5,162,074 | A | 11/1992 | Hills | |
| 5,445,884 | A | 8/1995 | Hoyt et al. | |
| 5,509,430 | A | 4/1996 | Berger | |
| 5,607,766 | A | 3/1997 | Berger | |
| 5,620,641 | A | 4/1997 | Berger | |
| 5,633,082 | A * | 5/1997 | Berger | 428/365 |
| 6,103,181 | A | 8/2000 | Berger | |
| 6,234,618 | B1 * | 5/2001 | Yamamoto et al. | 347/86 |
| 6,412,932 | B1 * | 7/2002 | Higuma et al. | 347/86 |
| 6,460,985 | B1 * | 10/2002 | Olsen et al. | 347/86 |
| 6,530,654 | B1 * | 3/2003 | Kitabatake et al. | 347/86 |
| 6,840,692 | B1 * | 1/2005 | Ward et al. | 401/199 |

FOREIGN PATENT DOCUMENTS

| | | |
|---|---|---|
| JP | 56-30197 | 6/1974 |
| WO | WO 96/39054 | 12/1996 |

OTHER PUBLICATIONS

"Bicomponent Fibers: A Personal Perspective", IFJ, Jun. 1998, pp. 26-42.

*Textured Yarn Technology*, vol. 1, "Production, Properties and Processing," Monsanto Co., 1967, pp. 13-14, 17.

"Fundamentals of Fibre Formation, The Science of Fibre Spinning and Drawing", ZIABICKI, pp. 366-373, 386.

* cited by examiner

POROUS SUBSTRATE FOR INK DELIVERY SYSTEMS

RELATED APPLICATIONS

This application claims priority to Provisional Application No. 60/436,085 filed Dec. 23, 2002, the disclosure of which is hereby incorporated by reference in its entirety.

FIELD AND BACKGROUND OF THE INVENTION

This invention relates to a substrate for ink delivery systems particularly inkjet printers.

A typical inkjet printer construction includes an inkjet printhead mounted within a carriage which is moved back and fourth across the media being printed. A control system activates the printhead to deposit ink droplets onto the media to form images or text. Ink is provided to the printhead from an ink supply. The ink supply must provide a reproducible supply of ink to the inkjet printhead. It has been generally practiced to arrange the supply and other components such that a negative pressure or back pressure is maintained. The negative pressure must be sufficient so that a head pressure associated with the ink supply is kept at a value that is lower than atmospheric pressure thereby preventing leakage.

One way of maintaining negative pressure is to use a means for absorbing ink in the ink supply. Such a means of media typically has a porous structure which is inert to the ink. Various materials and structures have been proposed for the absorbing means or media: See, for example, U.S. Pat. Nos. 4,751,527, 4,771,295, 5,633,082, 5,657,065, 6,460,985 and 6,485,136, the disclosures of which are incorporated herein by reference in their entirety. However there is always a need for improved materials and ways of making such materials.

SUMMARY OF THE INVENTION

An ink absorbing substrate suitable for use in inkjet printing systems is provided. The ink absorbing substrate comprises at least one continuous fiber bonded to itself at points of contact to form a substantially self-sustaining structure for retaining ink. The continuous fiber comprises a bicomponent fiber having a core material and a sheath material at least partially surrounding the core material. The core material comprises a crystalline thermoplastic polymer and the sheath material comprises low density polyethylene modified with a cycloolefin copolymer.

DETAILED DESCRIPTION OF THE INVENTION

Figure 1:
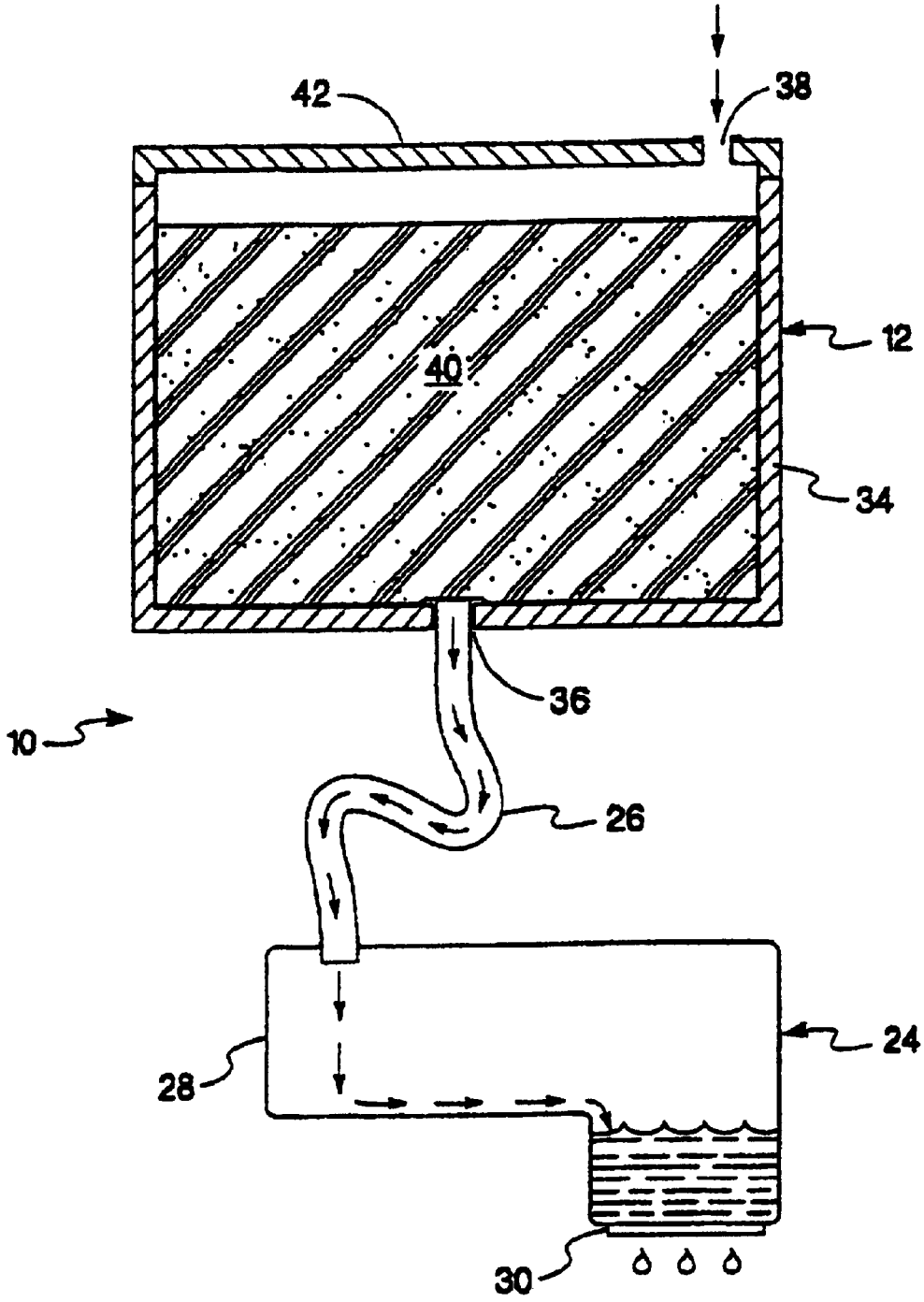
FIG. 1 is a schematic representation of the ink container of the the present invention and an inkjet printhead that receives ink from the ink container.

The present invention provides an ink absorbing substrate formed from a continuous bicomponent fiber. The ink absorping substrate is preferably used within an inkjet printer but is also applicable to writing and marking instruments, filtration media and the like. The continuous bicomponent fibers are fused to each other to define a three-dimensional porous substrate wherein the continuous bicomponent fibers are bonded together at points of contact. Such bonding forms a self-sustaining structure. Preferably, the core material and the sheath material are different with the sheath material having a higher melting temperature than the core material.

The fibers of the ink reservoirs of the present invention can be physically bonded or fused together by conventional means known in the art, e.g., by the use of heat and/or pressure. Heat bonding of a typical fiber bundle can be achieved by heating the fiber bundle at about 120° C. to about 250° C. for about ½ minute to about 5 minutes.

The fibers in the ink reservoirs are preferentially oriented substantially longitudinally along the center axis of the cylindrical form, since such orientation provides for a good transport or movement of the ink from the end of the reservoir most distal to the printhead instrument point to the end most proximal to the printhead. However, the fibers of ink reservoirs of the invention can be of a more random orientation and the invention is not limited to a specific fiber orientation.

The fibers in the ink reservoirs of the present invention can be of any length or shape (e.g., can be crimped, crenulated or zig-zagged). The fiber shape can be circular or oval, cross or x-shaped, tri-lobal or y-shaped, or h-shaped just to name a few possible cross-sections. Regarding length, the fibers can be cut to various sizes, e.g. 0.5 inch or higher, but it is preferred that the fibers of the fiber bundle are substantially the same length as the ink reservoir.

The ink reservoirs of the invention can also optionally contain other additives, which can be designed, for example, to enhance wettability and/or flow characteristics of the ink. Such additives include block copolymers of ethylene and propylene oxide that are commonly used as surfactants, polymeric organosilicone compounds that are commonly used as surfactants, surfactants derived from long chain aliphatic and aromatic carboxylic and sulfonic acids, and other surfactants commonly used to improve the wettability of a surface. These additives are typically present in an amount of about 0.01 to about 3 weight %, based on the total weight of the fiber bundle.

The network of fibers are preferably formed using a melt blown fiber process. For such a melt blow fiber process, it may be desirable to select a core material of a melt index similar to the melt index of the sheath polymer. Using such a melt blown fiber process, the main requirement of the core material is that it is crystallized when extruded or crystallizable during the melt blowing process. Therefore, other highly crystalline thermoplastic polymers such as high density polyethylene terephthalate, as well as polyamides such as nylon and nylon 66 can also be used. Polypropylene is a preferred core material due to its low price and ease of processibility. In addition, the use of a polypropylene core material provides core strength allowing the production of fine fibers using various melt blowing techniques. The core material should be capable of forming a bond to the sheath material as well. Various melt blowing techniques are described in, for example, U.S. Pat. Nos. 5,633,082 and 4,795,668, the disclosures of which are incorporated herein in their entirety.

With respect to the sheath, a low density polyethylene ("LDPE") blended with a cycloolefinic copolymer ("COC") is preferred. The COCs used in the present invention are amorphous polymers having a cyclic olefin structure, and preferably have a glass transition temperature of 50 to 250° C., especially 80 to 200° C., more especially 80 to 160° C. If the glass transition temperature is less than 50° C., the rigidity is not sufficient and, therefore, a balance between rigidity and impact resistance is deteriorated. If the glass transition temperature is more than 250° C. the processability is lowered. Preferably, the COC used in the present invention comprises, based on the total weight thereof, 1 to 99% by weight of at least one cyclic olefin, preferably a cyclic olefin of the formula (I), (II), (III), (IV), (V), (VI) or (VII) described below, wherein $R^1$ to $R^8$ are the same or different and each is hydrogen atom or a hydrocarbon group having 1 to 20 carbon atoms, provided that at least two of $R^1$ to $R^8$ may form a ring, and n in the formula (VII) is an integer of 2 to 10; 99 to 1% by weight of at least one non-cyclic olefin, preferably a non-cyclic olefin of the formula (VIII) described below, wherein $R^9$ to $R^{12}$ are the same or different and each is hydrogen atom or a hydrocarbon group having 1 to 20 carbon atoms, and

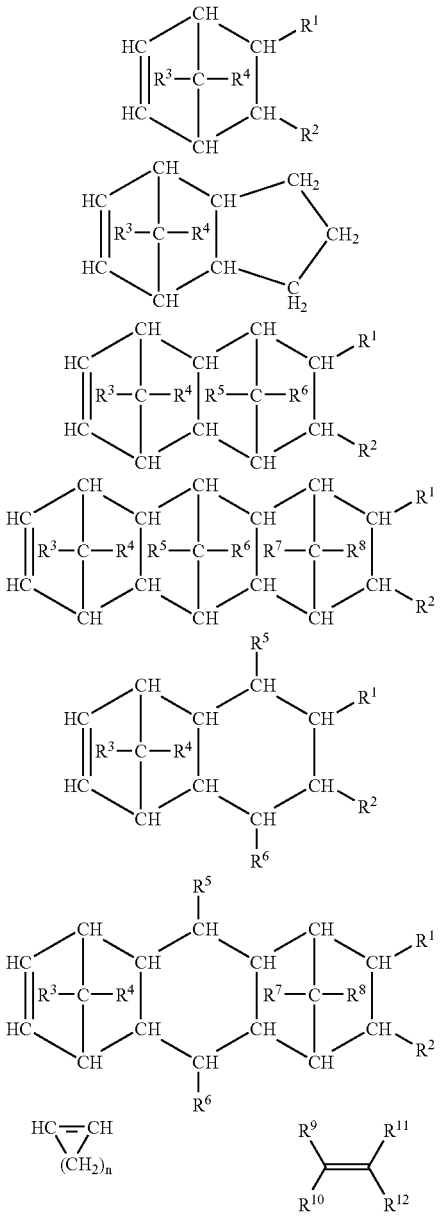

Preferable COCs are copolymers of a cyclic olefin having a norbornene-based structure, preferably norbornene, tetracyclododecene or cyclic olefins having a structure derived from them, and a non-cyclic olefin having a terminal double bond, e.g., an alpha-olefin, preferably ethylene or propylene. Among them, norbornene-ethylene, norbornene-propylene, tetracyclo-dodecene-ethylene and tetracyclododecene-propylene copolymers are particularly preferred.

Commercially available cycloolefin copolymers used in the present invention are, for example, those available under the trade mark "Topas" made by Hoechst Aktiengesellschaft, Germany, and the trade mark "APEL" made by Mitsui Petrochemical Industries, Ltd.

Preferably the COC suitable for the objects of the present invention has a viscosity number of 25 to 200 ml/g, especially 40 to 120 ml/g, more especially 40 to 80 ml/g, measured in decalin at 135° C. If the viscosity number is less than 25 ml/g, the rigidity of molded articles obtained from the resin compositions is insufficient, and if the viscosity number is more than 200 ml/g, the molding processability of the resin compositions tend to lower.

During normal steam bonding of biocomponent fibers, where the sheath component is pure LDPE, there is considerable wear of LDPE from the fiber sheath and deposits of LDPE on steam forming dies. These deposits begin to occur very quickly on a clean die (on the order of a few minutes), and lead to the formation of grooves and progressively smaller size on the bonded parts. As the deposits continue to build up, operability becomes poor, and dies must be exchanged for clean parts, resulting in downtime.

A methodology for combating LDPE buildup has been to use expensive dies utilizing a steam bonding zone and a chilled zone. These dies reduce buildup, but do not eliminate it. Another methodology is to use fluoropolymer low friction coatings on dies. Again, this reduces buildup but does not eliminate it.

The addition of COC polymer to LDPE (preferably a dry blend of chip) prior to extrusion of the fiber results in a blended COC/LDPE polymer which can be processed in a normal steam forming die with significantly reduced, or eliminated, buildup. Die buildup is less on conventional steam forming dies than observed with standard LDPE on special steam/chilled dies. We have observed this phenomenon on parts made from bicomponent melt blown webs, bicomponent fibers and bicomponent fiber tows.

Addition of COC to LDPE in the sheath zone of a bicomponent melt blown machine, with polypropylene as the core polymer, also significantly improves the bulkiness of the resulting web vs. LDPE sheath melt blown webs without added COC, making this material much mkore suitable for thermal or steam bonding into three-dimensional shaped bonded fiber elements. A bulky web leads to improved fiber homogeneity in the bonded fiber element, a characteristic which is critical for uniform fluid absorption and desorption. We found that Topas 5013 available from Ticuna, utilized at a concentration of about 20% gave the best performance regarding processing (fiber formation, web loft, fiber bonding and a lack of die deposits). There are possible ranges of Topas addition, which may change if the grade of Topas is changed. Moreover, a sheath of 100% COC is contemplated by the present invention.

The ink absorbing substrate formed from such a bicomponent fiber can be used in an inkjet printer system such as described in U.S. Pat. No. 6,460,985 the disclosure of which is incorporated herein by reference in its entirety. For example, FIG. 1 is a schematic representation of the printing system 10 which includes the ink supply or ink container 12, an inkjet printhead 24, and a fluid interconnect 26 for fluidically interconnecting the ink container 12 and the printhead 24.

The printhead 24 includes a housing 28 and an ink ejection portion 30. The ink ejection portion 30 is responsive to activation signals by the printer portion 14 for ejecting ink to accomplish printing. The housing 28 defines a small ink reservoir for containing ink 32 that is used by the ejection portion 30 for ejecting ink. As the inkjet printhead 24 ejects ink or depletes the ink 32 stored in the housing 28, the ink container 12 replenishes the printhead 24. A volume of ink contained in the ink supply 12 is typically significantly larger than a volume of ink container within the housing 28. Therefore, the ink container 12 is a primary supply of ink for the printhead 24.

The ink container 12 includes a reservoir 34 having a fluid outlet 36 and an air inlet 38. Disposed within the reservoir 34 is a network of fibers that are heat fused at points of contact to define an ink absorping substrate 40. The ink absorbing substrate storage member 40 performs several important functions within the inkjet printing system 10. The ink absorbing substrate storage member 40 must have sufficient capillarity to retain ink to prevent ink leakage from the reservoir 34 during insertion and removal of the ink container 12 from the printing system 10. This ink absorbing substrate force must be sufficiently great to prevent ink leakage from the ink reservoir 34 over a wide variety of environmental conditions such as temperature and pressure changes. The ink absorbing substrate should be sufficient to retain ink within the ink container 12 for all orientations of the reservoir 34 as well as undergoing shock and vibration that the ink container 12 may undergo during handling.

Once the ink container 12 is installed into the printing system 10 and fluidically coupled to the printhead by way of fluid interconnect 26, the capillary storage member 40 should allow ink to flow from the ink container 12 to the inkjet printhead 24. As the inkjet printhead 24 ejects ink from the ejection portion 30, a negative gauge pressure, sometimes referred to as a back pressure, is created in the printhead 24. This negative gauge pressure within the printhead 24 should be sufficient to overcome the capillary force retaining ink within the ink absorbing substrate 40, thereby allowing ink to flow from the ink container 12 into the printhead 24 until equilibrium is reached. Once equilibrium is reached and the gauge pressure within the printhead 24 is equal to the capillary force retaining ink within the ink container 12, ink no longer flows from the ink container 12 to the printhead 24. The gauge pressure in the printhead 24 will generally depend on the rate of ink ejection from the ink ejection portion 30. As the printing rate or ink ejection rate increases, the gauge pressure within the printhead will become more negative causing ink to flow at a higher rate to the printhead 24 from the ink container 12. In one preferred inkjet printing system 10 the printhead 24 produces a maximum backpressure that is equal to 10 inches of water or a negative gauge pressure that is equal to 10 inches of water.

The printhead 24 can have a regulation device included therein for compensation for environmental changes such as temperature and pressure variations. If these variations are not compensated for, then uncontrolled leaking of ink from the printhead ejection portion 30 can occur. In some configurations of the printing system 10 the printhead 24 does not include a regulation device, instead the ink absorbing substrate is used to maintain a negative back pressure in the printhead 24 over normal pressure and temperature excursions. The capillary force of the ink absorbing substrate tends to pull ink back to the capillary member, thereby creating a slight negative back pressure within the printhead 24. This slightly negative back pressure tends to prevent ink from leaking or drooling from the ejection portion 30 during changes in atmospheric conditions such as pressure changes and temperature changes. The capillary member 40 should provide sufficient back pressure or negative gauge pressure in the printhead 24 to prevent drooling during normal storage and operating conditions.

The embodiment in FIG. 1 depicts an ink container 12 and a printhead 24 that are each separately replaceable. The ink container 12 is replaced when exhausted and the printhead 24 is replaced at end of life. The method and apparatus of the present invention is applicable to inkjet printing systems 10 having other configurations than those shown in FIG. 2. For example, the ink container 12 and the printhead 24 can be integrated into a single print cartridge. The print cartridge which includes the ink container 12 and the printhead 24 is then replaced when ink within the cartridge is exhausted.

Figure 2:
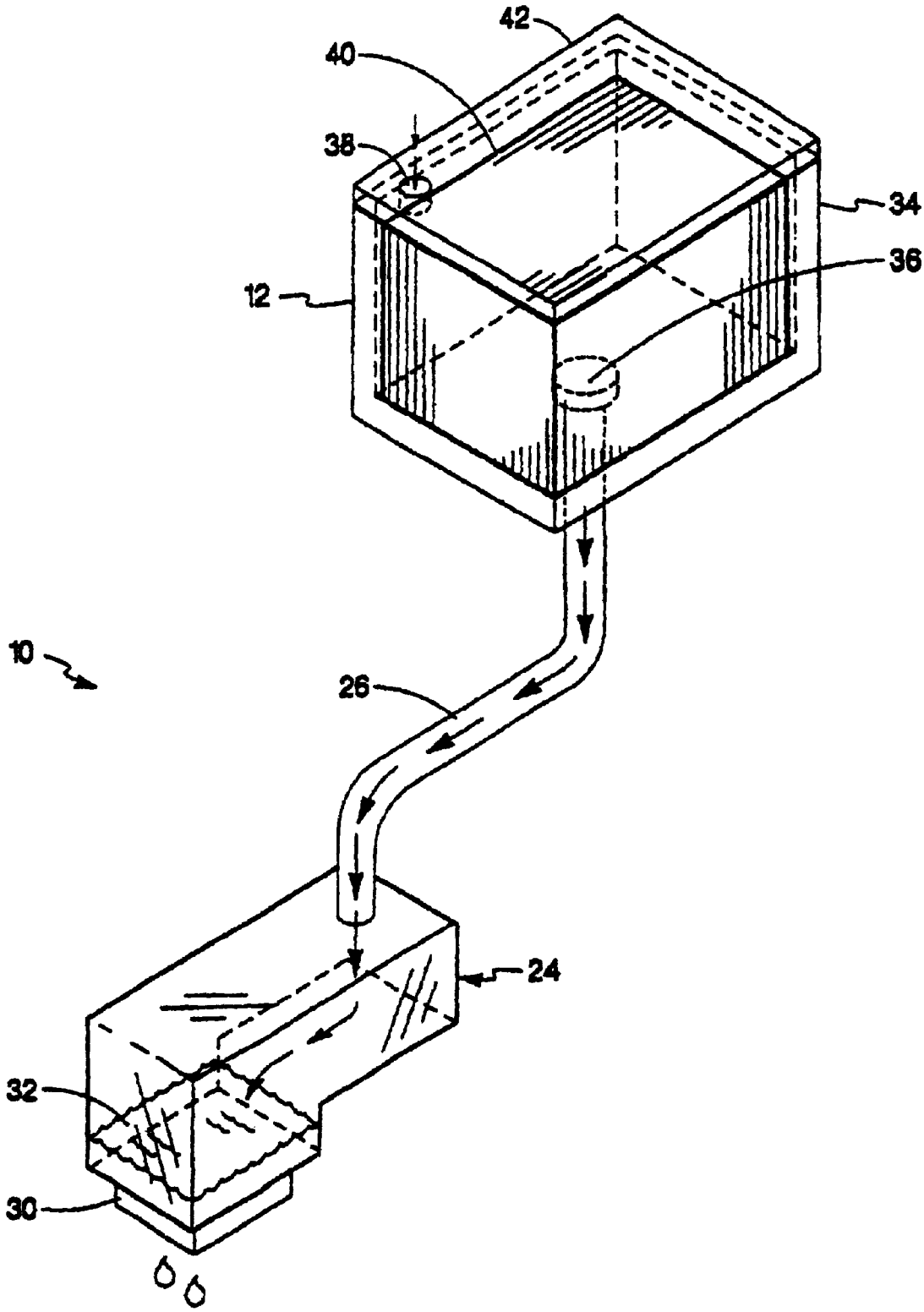
FIG. 2 is a schematic representation of the ink container coupled to an inkjet printhead.

The ink container 12 and printhead 24 shown in FIG. 2 contain a single color ink. Alternatively, the ink container 12 can be partitioned into three separate chambers with each chamber containing a different color ink. In this case, three printheads 24 are required with each printhead in fluid communication with a different chamber within the ink container 12. Other configurations are also possible, such as more or less chambers associated with the ink container 12 as well as partitioning the printhead and providing separate ink colors to different partitions of the printhead or ejection portion 30.

FIG. 2 shows inkjet printing system 10 of the present invention in operation. With the ink container 12 of the present invention properly installed into the inkjet printing system 10, fluidic coupling is established between the ink container 12 and the inkjet printhead 24 by way of a fluid conduit 26. The selective activation of the drop ejection portion 30 to eject ink produces a negative gauge pressure within the inkjet printhead 24. This negative gauge pressure draws ink retained in the interstitial spaces between fibers 46 within the ink absorbing substrate. Ink that is provided by the ink container 12 to the inkjet printhead 24 replenishes the inkjet printhead 24. As ink leaves the reservoir through fluid outlet 36, air enters through a vent hole 38 to replace a volume of ink and exits the reservoir 34, thereby preventing the build up of a negative pressure or negative gauge pressure within the reservoir 34.

DSC Analysis

| Material | 110 | 210 | 310 | 410 | 510 |
|---|---|---|---|---|---|
| Topas ® 5013 | 0% | 10% | 20% | 30% | 50% |
| Equistar NA594 LDPE | 100% | 90% | 80% | 70% | 50% |
| $T_m$ (1st Heat) (° C.) | 105.7 | 106.3 | 106.0 | 106.1 | 105.7 |
| $T_c$ | 87.1 | 86.4 | 85.8 | 86.5 | 86.2 |
| $\Delta H_c$ (J/g) | 72.9 | 65.4 | 58.4 | 58.3 | 35.2 |
| $T_m$ (2nd Heat) (° C.) | 106.6 | 106.9 | 107.5 | 106.7 | 106.7 |
| $\Delta H_m$ (J/g) | 103.7 | 93.4 | 81.4 | 84.6 | 53.8 |

The addition of the cyclic olefin copolymer improved the web bulk compared to pure low density polyethylene. The smaller fibers and lower mass through put settings also produced better web. This makes intuitive sense because there is more surface area for cooling and less mass to cool at those settings. At the higher COC ratios the standard tooling set up for bonding the LDPE reservoirs is unacceptable, standard polyester tooling is required. All else being equal, the standard polyester tooling is preferred due to considerations with fabrication, set up, flexibility, and process experience.

The invention has been described with respect to the preferred embodiments set forth above. It should be appreciated however that these embodiments are for the purposes of illustrating the invention, and are not intended to limit the scope of the invention as defined by the claims.

That which is claimed is:

1. A ink absorbing substrate suitable for use in inkjet printing systems, the substrate comprising at least one continuous fiber bonded to itself at points of contact to form a substantially self-sustaining structure for retaining ink, the continuous fiber comprising a bicomponent fiber having a core material and a sheath material at least partially surrounding the core material, the core material comprising a crystalline thermoplastic polymer and the sheath material comprising low density polyethylene modified with a cycloolefin copolymer.

2. The ink absorbing substrate according to claim 1, wherein said fiber has a shape selected from the group consisting of circular, oval, cross or x-shaped, trilobal, and h-shaped.

3. The ink absorbing substrate according to claim 1, where said fibers are formed using a melt blown fiber process.

4. The ink absorbing substrate according to claim 1, wherein said crystalline thermoplastic polymer of the core material is selected from the group consisting of high density polyethylene terephthalate, polyamides and polypropylene.

5. The ink absorbing substrate according to claim 1, wherein the cycloolefin copolymer, based on the total weight thereof comprises 1 to 99% by weight of at least one cyclic olefin of the formula (I), (II), (III), (IV), (V), (VI) or (VII), wherein $R^1$ to $R^8$ are the same or different and each is hydrogen atom or a hydrocarbon group having 1 to 20 carbon atoms, provided that at least two of $R^1$ to $R^8$ may form a ring, and n in the formula (VII) is an integer of 2 to 10; 99 to 1% by weight of at least one non-cyclic olefin, wherein $R^9$ to $R^{12}$ are the same or different and each is hydrogen atom or a hydrocarbon group having 1 to 20 carbon atoms, and

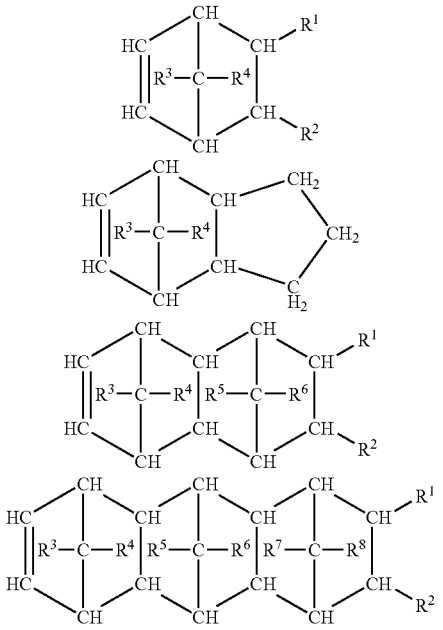

-continued

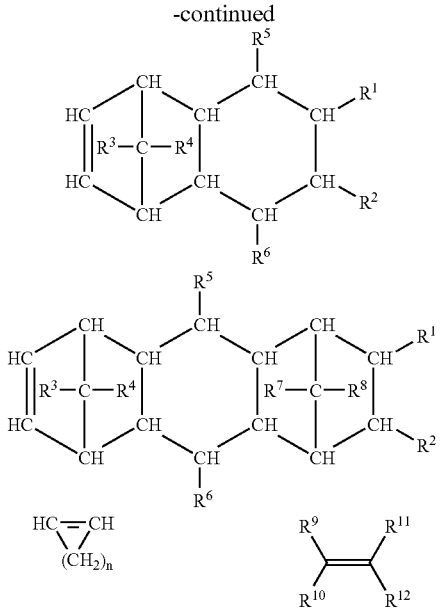

6. The ink absorbing substrate according to claim 1, wherein the cycloolefin copolymer is a copolymer of a cyclic olefin having a norbornene-based structure.

7. The ink absorbing substrate according to claim 1, wherein the cycloolefin copolymer has a viscosity number of 25 to 200 ml/g.

8. A ink absorbing substrate suitable for use in inkjet printing systems, the substrate comprising at least one continuous fiber bonded to itself at points of contact to form a substantially self-sustaining structure for retaining ink, the continuous fiber comprising a bicomponent fiber having a core material comprising polypropylene and a sheath material comprising 0 to 100 percent by weight low density polyethylene and 0.1 to 100 percent cycloolefin copolymer.

9. A ink absorbing substrate suitable for use in inkjet printing systems, the substrate comprising at least one continuous fiber bonded to itself at points of contact to form a substantially self-sustaining structure for retaining ink, the continuous fiber comprising a bicomponent fiber having a core material comprising polypropylene and a sheath material comprising 0 to 100 percent by weight low density polyethylene and 0.1 to 100 percent cycloolefin copolymer.

10. An ink container for providing ink to an inkjet printhead, the ink container comprising:

a reservoir for containing the ink, the ink container when inserted into a printing system having a top and a bottom relative to a gravitational frame of reference, the ink container further including a fluid outlet proximate the bottom of the ink container for permitting ink flow from the reservoir to the printhead, the reservoir having a rectangular configuration; and an ink absorbing substrate having a rectangular configuration, said member disposed in said reservoir for generating a capillary force on the ink in the reservoir, said ink absorbing member including at least one continuous fiber defining a three dimensional porous member with the at least one continuous fiber bonded to itself at points of contact to form a self sustaining structure for retaining the ink and is disposed within the reservoir, the continuous fiber comprising, a bicomponent fiber having a core material and a sheath material at least partially surrounding the core material, the core material comprising a crystalline thermoplastic polymer and the sheath material comprising low density polyethylene modified with a cycloolefin copolymer wherein ink drawn from the self sustaining structure is provided to the inkjet printhead, said ink absorbing member having a general fiber orientation in a direction parallel to said bottom of said reservoir.

11. A method of providing ink to an ink reservoir for use in an inkjet printing system, the method comprising:

providing an ink reservoir having a network of fibers disposed therein, the fibers comprising bicomponent fibers having a core material and a sheath material at least partially surrounding the core material, the core material comprising a crystalline thermoplastic polymer and the sheath material comprising low density polyethylene modified with a cycloolefin copolymer, the network of fibers being heat fused to each other to define intercommunicating interstitial spaces, the reservoir having a rectangular configuration with a height dimension, a width dimension and a length dimension, each of said dimensions greater than one inch, and wherein the ink reservoir when installed into an ink jet printing system has a top and a bottom relative to a gravitational frame of reference, the ink reservoir further including a fluid outlet proximate the bottom of the ink reservoir, and said network of fibers has a general fiber orientation in a direction parallel to said bottom;

providing ink to the ink reservoir;

drawing the ink provided to the ink reservoir into the intercommunicating interstitial spaces by means of capillary action.

12. An ink container for providing ink to an inkjet printhead, the ink container comprising:

a reservoir for containing the ink, the ink container when inserted into a printing system having a top and a bottom relative to a gravitational frame of reference, the ink container further including a fluid outlet proximate the bottom of the ink container for permitting ink flow from the reservoir to the printhead, the reservoir having a rectangular configuration with a height dimension, a width dimension and a length dimension, and wherein each of said dimensions is greater than one inch; and an ink absorbing member disposed in said reservoir for generating a capillary force on the ink in the reservoir, said ink absorbing member including at least one continuous fiber defining a three dimensional porous member with the at least one continuous fiber bonded to itself at points of contact to form a rectangular, self sustaining structure for retaining the ink, the continuous fibers comprising biocomponent fibers having a core material and a sheath material at least partially surrounding the core material, the core material comprising a crystalline thermoplastic polymer and the sheath material comprising low density polyethylene modified with a cycloolefin copolymer wherein ink drawn from the self sustaining structure is provided to the inkjet printhead, said ink absorbing member having a rectangular configuration having a length dimension, a height dimension and a width dimension, each of said dimensions greater than one inch, said ink absorbing member having a general fiber orientation in a direction parallel to said bottom of said reservoir.

13. An ink container for providing ink to an inkjet printhead, the ink container comprising:

a reservoir for containing the ink, the ink container when inserted into a printing system having a top and a bottom relative to a gravitational frame of reference, the ink container further including a fluid outlet proximate the bottom of the ink container for permitting ink flow from the reservoir to the printhead, the reservoir having a rectangular configuration; and an ink absorbing substrate having a rectangular configuration, said member disposed in said reservoir for generating a capillary force on the ink in the reservoir, said ink absorbing member including at least one continuous fiber defining a three dimensional porous member with the at least one continuous fiber bonded to itself at points of contact to form a self sustaining structure for retaining the ink and is disposed within the reservoir, the continuous fiber comprising, a bicomponent fiber having a core material and a sheath material at least partially surrounding the core material, the core material comprising a crystalline thermoplastic polymer and the sheath material comprising low density polyethylene modified with a cycloolefin copolymer wherein ink drawn from the self sustaining structure is provided to the inkjet printhead, said ink absorbing member having a general fiber orientation in a direction parallel to said bottom of said reservoir.

14. A primary ink storage device for providing ink to an inkjet printhead, the primary ink storage device comprising:

a reservoir for containing ink, the reservoir having a fluid outlet therein, the ink container when inserted into a printing system having a top and a bottom relative to a gravitational frame of reference, the ink container further including a fluid outlet proximate the bottom of the ink container for permitting ink flow from the reservoir to the printhead, the reservoir having a rectangular configuration with a height dimension, a width dimension and a length dimension, and wherein each of said dimensions is greater than one inch; and a network of fibers disposed within the reservoir to retain ink, the network of fibers being heat fused to each other to define a rectangular, self-sustaining ink absorbing substrate for storing ink within the reservoir wherein ink drawn from the network of fibers is provided to the inkjet printhead the fibers comprising b: component fibers having a core material and a sheath material at least partially surrounding the core material, the core material comprising a crystalline thermoplastic polymer and the sheath material comprising low density polyethylene modified with a cycloolefin copolymer, the ink absorbing substrate having a rectangular configuration with a height dimension, a width dimension and a length dimension, and wherein each of said dimensions is greater than one inch, said network of fibers having a general fiber orientation in a direction parallel to said bottom of said container.

15. A method of providing ink to an ink reservoir for use in an inkjet printing system, the method comprising:

providing an ink reservoir having a network of fibers disposed therein, the fibers comprising bicomponent fibers having a core material and a sheath material at least partially surrounding the core material, the core material comprising a crystalline thermoplastic polymer and the sheath material comprising low density polyethylene modified with a cycloolefin copolymer, the network of fibers being heat fused to each other to define intercommunicating interstitial spaces, the reservoir having a rectangular configuration with a height dimension, a width dimension and a length dimension, each of said dimensions greater than one inch, and wherein the ink reservoir when installed into an ink jet printing system has a top and a bottom relative to a gravitational frame of reference, the ink reservoir further including a fluid outlet proximate the bottom of the ink reservoir, and said network of fibers has a general fiber orientation in a direction parallel to said bottom;

providing ink to the ink reservoir;

drawing the ink provided to the ink reservoir into the intercommunicating interstitial spaces by means of capillary action.

16. An ink container for providing ink to an inkjet printhead, the ink container comprising:

a reservoir for containing the ink, the ink container when inserted into a printing system having a top and a bottom relative to a gravitational frame of reference, the ink container further including a fluid outlet proximate the bottom of the ink container for permitting ink flow from the reservoir to the printhead, the reservoir having a rectangular configuration with a height dimension, a width dimension and a length dimension, and wherein each of said dimensions is greater than one inch; and an ink absorbing member disposed in said reservoir for generating a capillary force on the ink in the reservoir, said ink absorbing member including at least one continuous fiber defining a three dimensional porous member with the at least one continuous fiber bonded to itself at points of contact to form a rectangular, self sustaining structure for retaining the ink, the continuous fibers comprising biocomponent fibers having a core material and a sheath material at least partially surrounding the core material, the core material comprising a crystalline thermoplastic polymer and the sheath material comprising low density polyethylene modified with a cycloolefin copolymer wherein ink drawn from the self sustaining structure is provided to the inkjet printhead, said ink absorbing member having a rectangular configuration having a length dimension, a height dimension and a width dimension, each of said dimensions greater than one inch, said ink absorbing member having a general fiber orientation in a direction parallel to said bottom of said reservoir.

17. A method of providing ink to an ink reservoir for use in an inkjet printing system, the method comprising:

providing an ink reservoir having a rectangular, self-sustaining network of fibers disposed therein said fibers comprising bicomponent fibers having a core material and a sheath material at least partially surrounding the core material, the core material comprising a crystalline thermoplastic polymer and the sheath material comprising low density polyethylene modified with a cycloolefin copolymer, the network of fibers having a length dimension, a height dimension and a width dimension, each of said dimensions greater than one inch, said fibers being heat fused to each other to define intercommunicating interstitial spaces, the reservoir having a rectangular configuration with a height dimension, a width dimension and a length dimension, each of said dimensions greater than one inch, and wherein the ink reservoir when installed into an ink jet printing system has a top and a bottom relative to a gravitational frame of reference, the ink reservoir further including a fluid outlet proximate the bottom of the ink reservoir, and said network of fibers has a general fiber orientation in a direction parallel to said bottom;

providing ink to the ink reservoir;

drawing the ink provided to the ink reservoir into the intercommunicating interstitial spaces by means of capillary action.

* * * * *